US005324193A

United States Patent [19]

Pan

[11] Patent Number: 5,324,193

[45] Date of Patent: Jun. 28, 1994

[54] AUTOMATICALLY LOCKABLE SAFETY LIGHTER FOR EASY OPERATION

[75] Inventor: Hsin-Chung Pan, Taipei, Taiwan

[73] Assignee: Platinum Precision Manufacture Corp., Taipei, Taiwan

[21] Appl. No.: 52,612

[22] Filed: Apr. 27, 1993

[51] Int. Cl.[5] ..... F23D 11/36

[52] U.S. Cl. ..... 431/153; 431/277

[58] Field of Search ..... 431/153, 276, 277

[56] References Cited

U.S. PATENT DOCUMENTS 5,165,885 11/1992 Iwahori ..... 431/153

5,197,870 3/1993 Yang ..... 431/153

*Primary Examiner*—Carroll B. Dority

[57] ABSTRACT

An easily operating safety lighter includes an actuating lever normally pivotally mounted on a top frame protruding upwardly from a gas container of the lighter for operatively sparking a flint for burning gas emitted from a gas valve of the lighter, a locking stem protruding downwardly from a depression member of the lever to be blocked on a retarding platform formed on a container cover for preventing a depression of the lever for igniting the lighter by a child, a coupling device having a pair of hook members respectively formed on the actuating lever and on the top frame for temporarily holding the actuating lever when pushing the lever frontwardly for unlocking the locking stem from the retarding platform of the container, thereby allowing a downward depression of the lever to enter the locking stem into a cavity recessed in the container cover for operatively igniting the lighter, and a restoring spring normally urging the locking stem of the actuating lever rearwardly when uncoupling the pair of hook members by a downward igniting depression of the lever for normally resting the locking stem on the retarding platform for an automatic locking purpose for safely preventing an ignition of the lighter.

2 Claims, 3 Drawing Sheets

AUTOMATICALLY LOCKABLE SAFETY LIGHTER FOR EASY OPERATION

BACKGROUND OF THE INVENTION

A conventional child resistant cigarette lighter such as disclosed in U.S. Pat. No. 4,832,596 to Glenn Morris includes a permanently attached stop member slidably mounted on a conventional disposable butane lighter for releasably engaging the gas valve actuating lever. The construction and arrangement of the lighter is such that an adult can easily manipulate the stop member and gas valve actuating lever while igniting, while such manipulation is beyond the dexterity of a child, thereby rendering the lighter child resistant.

However such a conventional gas lighter still has the following drawbacks:

1. The stop member 9 is slidably mounted on the lighter outside a butane container of the lighter, which may obstruct a normal igniting operation when using such a lighter and may even cause inconvenience when storing or handling such a lighter because its increased volume requiring an additional space for allocating such specially-constructed lighter such as in a purse or a pocket.

2. The stop member 9 includes an elongate rod 10 which may be easily broken or deformed by any external object or force to influence its normal operation.

SUMMARY OF THE INVENTION

The object of the present invention is to provide an easily operating safety lighter including an actuating lever normally pivotally mounted on a top frame protruding upwardly from a gas container of the lighter for operatively sparking a flint for burning gas emitted from a gas valve of the lighter, a locking stem protruding downwardly from a depression member of the lever to be blocked on a retarding platform formed on a container cover for preventing a depression of the lever for igniting the lighter by a child, a coupling device having a pair of hook members respectively formed on the actuating lever and on the top frame for temporarily holding the actuating lever when pushing the lever frontwardly for unlocking the locking stem from the retarding platform of the container, thereby allowing a downward depression in the lever to enter the locking stem into a cavity recessed on the container cover for operatively igniting the lighter, and a restoring spring normally urging the locking stem of the actuating lever rearwardly when uncoupling the pair of hook members by a downward igniting depression of the lever for normally resting the locking stem on the retarding platform for an automatic locking purpose for safely preventing an ignition of the lighter.

DETAILED DESCRIPTION

Figure 1:
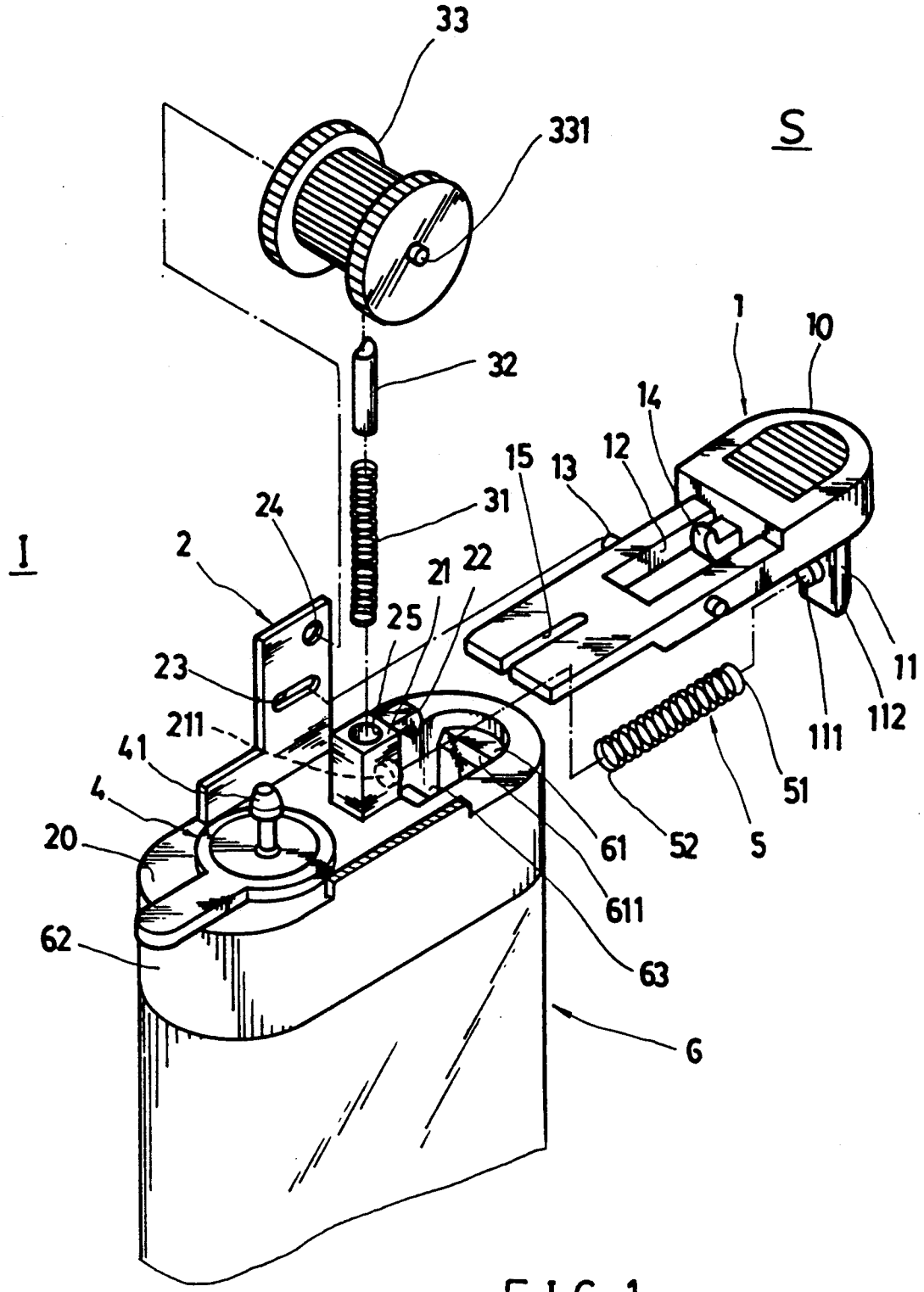
FIG. 1 is a perspective view of the present invention.
Figure 2:
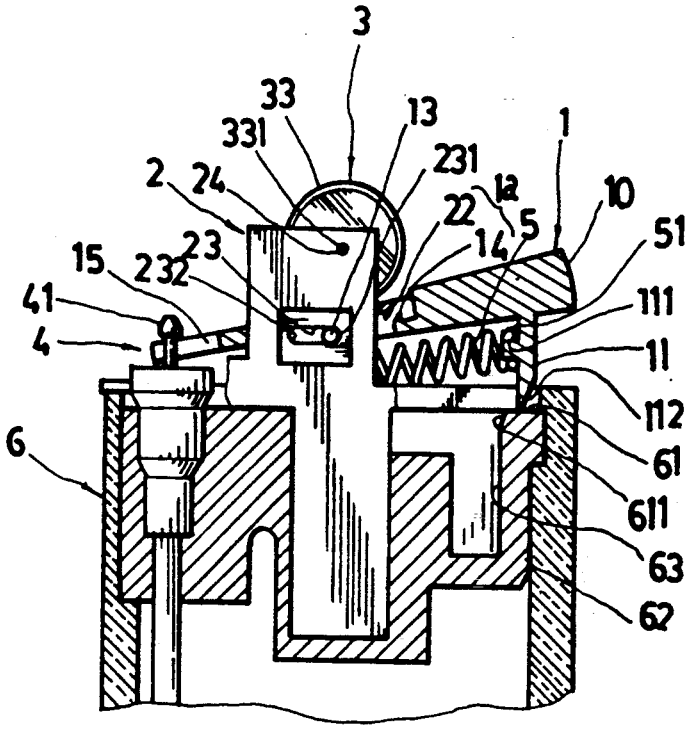
FIG. 2 is a sectional drawing of the present invention when locked.

As shown in FIGS. 1 and 2, the present invention comprises: an actuating lever 1 pivotally mounted on a top frame 2 formed on a container cover 62 of a gas container 6 filled with liquid petroleum gas such as butane in the container 6 having an igniting means 3 and a gas value 4 provided on the gas lighter, and a restoring spring 5 retained between the top frame 2 and the lever 1.

The actuating lever 1 generally inclined upwardly towards a striking side S of the container 6 as urged by the restoring spring 5 includes: a depression member 10 formed on a "force" end of the actuating lever 1 at the striking side S of the gas container 6, a locking stem 11 protruding downwardly from the depression member 11 for normally locking the actuating lever 1 on a container cover 62, a lever pivot 13 serving as a "fulcrum" of the actuating lever 1 and transversely formed on a middle portion of the lever 1 to be pivotally mounted on the top frame 2, a central opening 12 formed in a central portion of the lever 1 movably engageable with a positioning column 21 of the top frame 2, a clip portion 15 formed on a "load" end of the lever 1 for movably holding a nozzle 41 of the gas valve 4 on the clip portion 15, and a first hook member 14 protruding inwardly from the depression member 10 towards an igniting side I of the container 6 opposite to the striking side S of the container 6.

Figure 3:
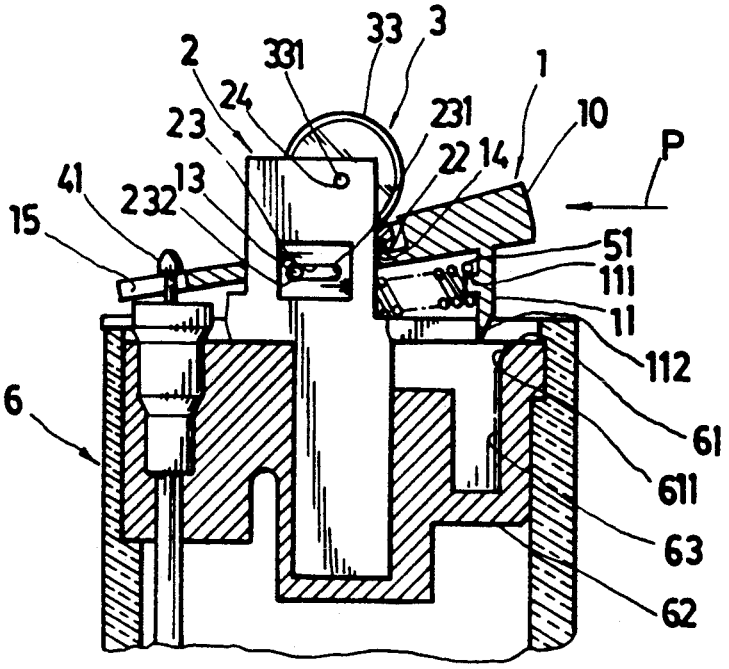
FIG. 3 is a sectional drawing of the present invention ready for ignition.
Figure 5:
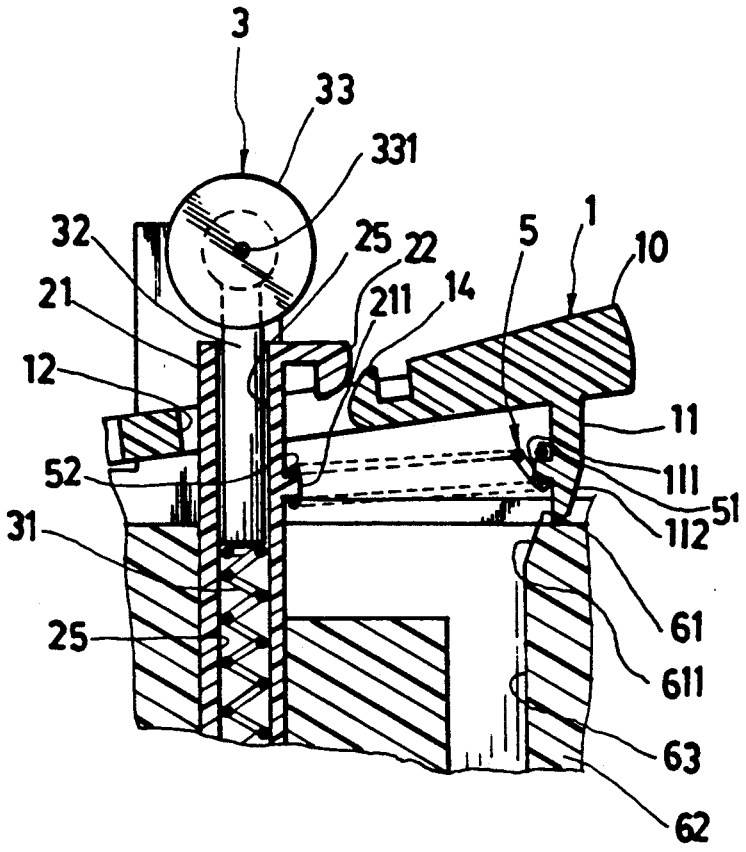
FIG. 5 shows an uncoupling of the lever and automatically restored to its locking state in accordance with the present invention.
Figure 4:
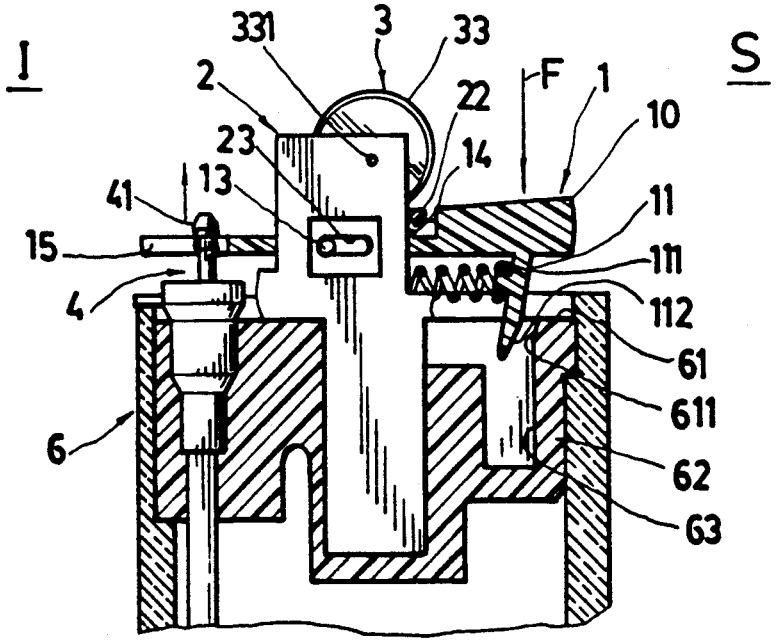
FIG. 4 shows a downward depression of the actuating lever of the present invention.

The top frame 2 is protruded upwardly from a container cover 62 sealably secured to an upper portion of the gas container 6 having a flat edge portion 20 formed in between the container cover 62 and a base portion of the top frame 2, a positioning column 21 protruding upwardly from the container cover 62 for mounting an igniting means 3 on the positioning column 21, a pivot slot 23 transversely formed in the positioning column 21 for slidably and pivotally engaging the lever pivot 13 of the actuating lever 1 in the pivot slot 23, and a second hook member 22 protruding outwardly from the positioning column 21 towards the striking side S of the container 6 to be operatively engageable with the first hook member 14 of the actuating lever 1 for igniting a gas lighter as shown in FIGS. 3, 4 which will be hereinafter described.

The igniting means 3 includes: a striker wheel 33 having a wheel shaft 331 rotatably engageable with a shaft hole 24 formed in a top portion of the positioning column 21 for rotatably mounting the strike wheel 33 on the top frame 2, and a flint 32 retained on a flint spring 31 inserted in a flint recess 25 deeply recessed in the positioning column 21 of the top frame 2. The gas valve 4 includes a nozzle 41 for emitting gas outwardly for igniting the lighter when depressing the lever 1 to raise the nozzle 41 by the clip portion 15 of the lever 1 to open the valve 4.

The restoring spring 5 includes a first spring end 51 held on a first lug 111 formed on a locking stem 11 of the actuating lever 1, and a second spring end 52, opposite to the first spring end 51, held on a second lug 211 formed on a positioning column 21 of the top frame 2, normally urging the actuating lever 1 outwardly towards a striking side S of the container 6 to allow the locking stem 11 to be rested on the retarding platform 61 of the container 6 by engaging and limiting a lever pivot 13 of the actuating lever 1 on a first slot end 231 of a pivot slot 23 transversely formed in the top frame.

The actuating lever 1 has the lever pivot 13 operatively engageable with a second slot end 232 of the pivot slot 23 formed on the top frame 2 opposite to the first slot end 231 of the pivot slot 23 when pushing (P) the actuating lever 1 frontwardly towards an igniting side I of the container 6 as shown in FIG. 3 to engage a first hook member 14 formed on the actuating lever 1 and a second hook member 22 of the top frame 2 to allow a downward depression (F) of a depression member 10 of the actuating lever 1 to enter a locking stem 11 of the actuating lever 1 into a stem-enterable cavity 63 recessed in a container cover 62 of the container 6 for operating the igniting means 3 for igniting a gas lighter as shown in FIG. 4.

The locking stem 11 of the actuating lever 1 is formed with a taper bottom portion 112 tapered downwardly inwardly towards a central portion of the container 6 to be slidably tangential to a sloping-surface portion 611 tapered downwardly inwardly from a retarding platform 61 on the container cover 62 towards the stem-enterable cavity 63, thereby allowing a smooth retraction movement of the locking stem 11 of the actuating lever 1 without being obstructed by a wall of the cavity 63 when automatically retracting the lever 1 as urged by the restoring spring 5 after depressing the lever 1 for igniting the gas lighter and uncoupling the two hook members 14, 22.

The present invention provides as automatic retraction of the actuating lever 1 to be always blocked on the platform 61 on the container 6 as urged by the restoring spring 5 and an automatic uncoupling action by disengaging the first hook member 14 on the lever from the second hook member 22 on the top frame 1 because an ignition operation requires a downward depression of the depression member 10 of the lever 1 to automatically disengage the first hook member 14 from the second hook member 22 for a smooth quick and automatic restoring operation of the lever 1 to be always locked after ignition, thereby preventing a kid's igniting for a better safety protection therefor.

When it is intended to ignite the lighter, the lever 1 should be frontwardly pushed (A) towards the igniting side I to couple the two hook members 14, 22 to overcome the elastic force from the restoring spring 5 to position the locking stem 11 above the cavity 63, allowing a downward depression of the lever 1 for igniting the lighter.

The first and second hook members 14, 22 form a coupling means 1*a* which may be modified to be other combination suitably coupled and uncoupled, which is not limited in this invention.

I claim:

1. A safety gas lighter comprising:

an igniting means and a gas valve formed on a gas container;

an actuating lever pivotally mounted on a top frame secured on a container cover of said gas container, said actuating lever generally inclined upwardly towards a striking side of the container as urged by the restoring spring including: a depression member formed on a first end of the actuating lever at the striking side of the gas container, a locking stem protruding downwardly from the depression member for normally allowing the actuating lever to be blocked on the container cover, a lever pivot transversely formed on a middle portion of the lever to be pivotally mounted on the top frame, a clip portion formed on a second end of the lever opposite to said depression member for movably holding a nozzle of the gas valve on the clip portion, said top frame having a positioning column protruding upwardly from the container cover for mounting said igniting means on the positioning column, a pivot slot transversely formed in the positioning column for slidably and pivotally engaging the lever pivot of the actuating lever in the pivot slot; said restoring spring including a first spring end held on a first lug formed on the locking stem of the actuating lever, and a second spring end, opposite to the first spring end, held on a second lug formed on the positioning column of the top frame, normally urging the actuating lever outwardly towards the striking side of the container to allow the locking stem to be blocked on the retarding platform of the container to prevent a depression of said lever and prevent an ignition of the gas lighter by engaging and limiting said lever pivot of the actuating lever on a first slot end of said pivot slot transversely formed in the top frame; and a coupling means including a first hook member protruding inwardly from the depression member towards an igniting side of the container opposite to the striking side of the container, and a second hook member protruding outwardly from the positioning column towards the striking side of the container to be operatively engageable with the first hook member of the actuating lever for igniting the gas lighter;

said actuating lever including the lever pivot operatively engageable with a second slot end of the pivot slot formed on the top frame opposite to the first slot end of the pivot slot when pushing the actuating lever frontwardly towards an igniting side of the container to engage the first hook member and the second hook member of the coupling means to allow a downward depression of a depression member of the actuating lever to enter the locking stem of the actuating lever into a stem-enterable cavity recessed in the container cover of the container for operating the igniting means for igniting the gas lighter and for uncoupling the first and second hook members of the coupling means to allow said restoring spring to automatically retract said lever and said locking stem to be blocked on said retarding platform for safety purpose.

2. A safety gas lighter according to claim 1, wherein said locking stem of the actuating lever is formed with a taper bottom portion tapered downwardly inwardly towards a central portion of the container to be slidably tangential to a sloping-surface portion tapered downwardly inwardly from a retarding platform on the container cover towards the stem-enterable cavity, thereby allowing a smooth retraction movement of the locking stem of the actuating lever to be normally blocked on the retarding platform as restored by the restoring spring.

* * * * *